United States Patent [19]

List

[11] Patent Number: 4,475,514

[45] Date of Patent: Oct. 9, 1984

[54] FUEL INJECTION PUMP FOR INTERNAL COMBUSTION ENGINES

[76] Inventor: Hans List, Heinrichstrasse 126, 8010 Graz, Austria

[21] Appl. No.: 452,316

[22] Filed: Dec. 22, 1982

[30] Foreign Application Priority Data

Dec. 23, 1981 [AT] Austria ..... 5550/81
Mar. 3, 1982 [AT] Austria ..... 828/82

[51] Int. Cl.[3] ..... F02M 47/00

[52] U.S. Cl. ..... 123/458; 123/459; 239/88

[58] Field of Search ..... 123/458, 459, 511, 512; 239/88–93, 585

[56] References Cited

U.S. PATENT DOCUMENTS

| | | | |
|---|---|---|---|
| 3,779,225 | 12/1973 | Watson et al. | 123/458 |
| 4,129,253 | 12/1978 | Bader, Jr. et al. | 239/88 |
| 4,182,492 | 1/1980 | Albert et al. | 239/92 |
| 4,343,280 | 8/1982 | Luscomb | 123/458 |
| 4,392,612 | 7/1983 | Deckard et al. | 239/88 |
| 4,408,718 | 10/1983 | Wich | 239/88 |

FOREIGN PATENT DOCUMENTS 2742466 3/1979 Fed. Rep. of Germany .

*Primary Examiner*—Magdalen Y. C. Moy
*Attorney, Agent, or Firm*—Watson, Cole, Grindle & Watson

[57] ABSTRACT

A fuel injection pump for internal combustion engines, in which a solenoid valve controlled by at least one of the state variables essential for operation of the engine, such as load, engine speed, pressure and temperature of combustion air, etc., controls the injection process by means of a shut-off device loaded by a spring on one end, the shut-off device being in one end position during the time of injection, but is subject to the feed pressure on both ends and is resting in the other end position while the pump is being filled. The chamber guiding the end of the slide-type shut-off device opposite the spring, is directly linked with the pump chamber of the high-pressure pump by a duct. In this manner the reversal of the slide takes place abruptly, which will permit a much better adaptation of the injection process to the different state variables of the combustion engine than before.

8 Claims, 7 Drawing Figures

FUEL INJECTION PUMP FOR INTERNAL COMBUSTION ENGINES

BACKGROUND OF THE INVENTION

The invention relates to a fuel injection pump for internal combustion engines, in which a solenoid valve controlled by at least one of the state variables essential for the operation of the engine, such as load, engine speed, pressure and temperature of combustion air, etc., controls the injection process by means of a shut-off device loaded by a spring on one end, the shut-off device being in one end position during the time of injection, whereas it is subject to the feed pressure on both ends and is resting in the other end position while the pump is being filled.

DESCRIPTION OF THE PRIOR ART

The known variety of fuel injection pumps with slanting edge control is marked by its complicated turning mechanism for the pump plungers whose actuation poses design problems; besides, in such pumps the amount of injected fuel will depend not only on the rotation angle of the pump plungers but also on other variables, e.g., engine speed and fuel temperature. For an economical operation of the engine with a minimum emission of pollutants it is essential, however, that the amount of fuel injected should be measured precisely. Therefore, the aim is to take into account any variables influencing the operation of the engine when determining the injection volume. With the known types of fuel injection pumps this in often difficult if not impossible.

German published patent application No. 27 42 466 is concerned with a fuel injection pump for internal combustion engines, in which a solenoid valve controlled by at least one of the state variables essential for the operation of the engine, such as load, engine speed, pressure and temperature of the combustion air, etc., is used for controlling the injection process via a shut-off device loaded by a spring on one end, this device assuming one end position during the injection phase, while being subject to the feed pressure on both ends and resting in the other end position during the filling phase of the pump.

For shifting the shut-off device, the fuel flowing in from the high-pressure pump is used in this variant; it will have to pass a choke bore, however, before it can act on the face of the valve body opposite of the valve cone serving as a shut-off device. As a consequence the pressure build-up in the pressure chamber is rather slow. This behavior which is not favorable to a precise control of the injection volume, is necessary in order to avoid any damage of the conical valve seat, which would be inevitable in the case of a sudden impact of the valve body.

SUMMARY OF THE INVENTION

It is the object of the present invention to avoid the disadvantages of the known types of injection pumps and to permit a better adaptation of the injection process to variations in the state variables of the internal combustion engine by an abrupt reversal of the slide element. Any damage to a valve seat or slide should of course be avoided carefully.

According to the invention, this is achieved by directly connecting the chamber guiding the end of the slide-type shut-off device opposite the spring with the pump chamber of the high-pressure pump by way of a duct.

In this way the reversal of the slide element takes place very abruptly, which will permit the injection process to be adapted to the different state variables of the combustion engine much better than before. In addition, there will be no damaging of the valve seats in this kind of pump, since in the end position the slide body will come to rest against the slide housing with a large contact area.

The solenoid valve will be able to take into account any combination of the variables influencing the amount of fuel to be injected, which, together with the abrupt slide reversal, will help to achieve optimum values for performance, fuel consumption and pollutant emission. Besides, any changes pertaining to the state variables may be taken account of fairly easily, since they will affect the electrical component of the solenoid valve only.

The design of the electrical control elements of the solenoid valve need not be discussed in detail, since the technical expert will have no trouble in establishing the desired dependency between the control of the solenoid valve and the above mentioned state variables.

Moreover, provisions may be made for adjusting or readjusting electrical control components without noticeably increasing manufacturing costs.

The fuel injection pump designed according to the invention may be used either in conjunction with a feed line and a nozzle, or as part of a pump/nozzle unit.

In an enhanced variant of the invention the pump body may be provided with an annular groove directly beneath the pump plunger resting in its upper end position, which is open towards the pump chamber and is connected with the fuel feeder duct of the pump, and the slide may be provided with an annular peripheral groove, which is connected via a bore with the chamber housing the spring that acts upon the slide and also connecting to the fuel feeder duct, and the peripheral groove of the slide may be covered by the pump body in the injection position of the slide, whereas it is connected with the pump chamber while the latter is being filled. This will permit a comparatively simple design of the mechanical component of the control unit which is not prone to failure.

The invention provides that the solenoid valve be situated in a connecting channel between the fuel feeder duct and the chamber containing that end of the slide away from the spring, and that it be loaded by a spring against its shutting direction, and that it be energized and thus shut during the injection process. As the injection process is much shorter than the process of filling and flow-off at the injection pump, this will result in savings with regard to both manufacturing and operating costs of the solenoid valve.

In order to ensure that the pressure distribution at the slide builds up and may be controlled correctly, the outflow bore of the slide may be provided with an adjustable throttling element according to another variant of the invention, whose opening is dimensioned such as to match the cross-sections of the nozzle openings and the load of the spring. This throttling element might also incorporate another slide. This is a simple way of ensuring that the pressure distribution on shutting the solenoid valve or the electromagnetically controlled slide quickly builds up such that the spring force is overcome, the slide is pressed into its end position and the connection between the pump chamber and the feeder duct is interrupted.

In order to be able to use a low-power solenoid valve while obtaining an optimum control speed, another variant of the invention provides that the solenoid valve should control the injection process by means of a control slide loaded on one end by a helical spring, where, during the time of injection, the feed pressure of the pump is acting on this end and the high pressure of the pump on the other end away from the helical spring, and where the control slide is in one end position, whereas during the filling phase of the pump, the feed pressure of the pump acts upon both ends of the slide as the high pressure of the pump is being carried towards the feeder duct by the action of the solenoid valve, and the slide is resting in the other end position due to the force of the helical spring. In this variant a relatively small valve is operated electrically, whereas the slide controlling the larger flow cross-sections is actuated hydraulically by its own pump pressure.

According to an advantageous proposal of the invention, the end of the control slide away from the helical spring may be permanently connected with the pressure chamber of the pump via a duct in the control slide; in the vicinity of the other slide end an annular groove may be provided which is connected via an axial bore with the end face constantly subject to the feed pressure of the pump, the axial distance of the above annular groove from that face being such that annular groove is situated in the pressure chamber of the pump in the end position away from the helical spring, whereas it is covered by the pump housing in the other end position. The cross-section of the axial bore should be dimensioned according to the requirements, of course. In an enhanced version, the outlet of the above axial bore may be controlled by a spring-loaded valve, e.g., a ball valve.

Instead of the ball valve other forms may be used, e.g., a disk valve. In an enhanced version of the invention the outlet of the axial bore may be controlled by a disk valve whose disk supports the helical spring loading the control slide. This will eliminate the use of an additional spring. The choice of the diameter ratio of the bore and disk areas will provide a further parameter for the adjustment of the pump operation.

In all these variants a careful matching of the spring forces and the valve or end face areas will permit fine tuning of the injection process.

According to a favorable variant, the disk of the disk valve may be provided with a cylindrical neck on the side opposite its sealing face, which acts as a stop for the control slide coming to rest against the cover of the chamber containing the helical spring.

Finally, the solenoid valve may be provided with a throttle slide comprising two webs placed at an axial distance from each other, with the web further away from the solenoid valve sliding in an axial through-bore of the control slide and effecting a control of the radial bores between the interior and exterior of the control slide, while the other web closer to the solenoid valve may be used for establishing the connection of the feeder duct of the pump with the pressure chamber on this side, in which case the control slide will abruptly move into its end position away from the helical spring, and will interrupt the fuel injection process, while the radial bores will open at the same time, now additionally leading from the pressure chamber to feeder duct of the pump.

DESCRIPTION OF THE DRAWING

Following is a more detailed explanation of a variant of the invention, as illustrated by the enclosed drawing, wherein.

Identical parts are given identical reference numbers.

Figure 1:
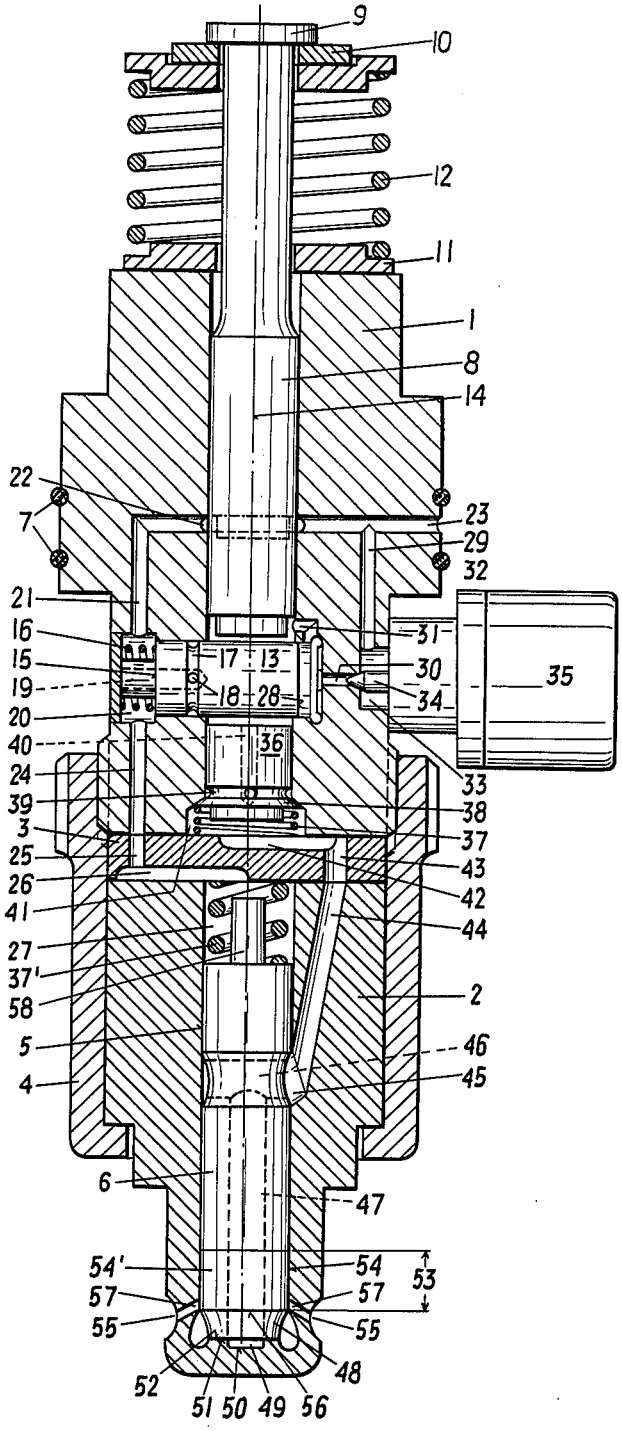
FIG. 1 shows an axial section of a pump/nozzle unit as described by the invention.

According to the invention, the pump/nozzle unit of FIG. 1 comprises a pump body 1 and a nozzle body 2, between which is inserted a plate 3 polished on both sides, and which are fastened together by means of a screw sleeve 4. The nozzle body 2 is provided with an axial bore 5 starting at the end adjacent plate 3, in which the nozzle pin 6 is guided axially. The entire pump/nozzle unit may be inserted in a manner not shown into a suitable bore on the cylinder head of the combustion engine and may be sealed by means of the sealing rings 7 carried by the pump body 1. The pump plunger 8 is fitted into the pump body in such a way that it may be moved axially. It is actuated in a manner not shown via a cam acting on its top 9 which is pre-loaded by a spring 12 via washers 10, 11.

For the control of the fuel volume delivered by the pump plunger a slide 13 is provided in the pump body 1 which may move at a right angle to the plunger axis 14. Its one end 15 on the left-hand side of the drawing is loaded by the helical spring 16 supported by the pump body 1.

The slide 13 has an annular groove 17 which is flow-connected with the axial bore 19 by a cross-bore 18. The chamber 20 containing the helical spring 16 is connected both with the feeder duct 23 via bore 21 and the annular groove 22, and with groove 26 in plate 3 via bore 24 and bore 25 in plate 3, the groove in turn being connected with the annular chamber 27 above the nozzle pin 6. The right end 28 of the slide 13 may be subjected to the feed pressure of the injection pump by way of bores 29 and 30, and may be connected via the connecting channel 31 with the pressure chamber 32 of the pump. The bores 29 and 30 may be linked by way of the annular chamber 33 and the solenoid valve 34 contained in it. The electrical component of the valve 34 is contained in the housing 35; as it is of a conventional type, it is not shown in this drawing.

The diameter of the slide 13 is smaller than that of the pump plunger 8, which will permit fuel to flow in the direction of the back valve 36 regardless of the position of the slide 13, the back valve 36 being loaded by the pressure spring 37 supported by plate 3. The pressure valve is provided with an annular groove 39 directly above the valve disk 38, into which groove opens the axial bore 40 provided for the passage of fuel. The back valve 36 opens into the annular chamber 41, which is connected with the feeder bore 44 in the nozzle body 2 via groove 42 and a bore 43 in plate 3. Starting from plate 3, the feeder bore 44 ends in an annular chamber 45 which is situated between nozzle body 2 and nozzle pin 6 and is formed by a recess in the nozzle pin. In the area of the annular chamber 45 the nozzle pin 6 has a cross-bore 46 which is connected with an axial bore 47 opening into a pressure chamber 49 in the nozzle body 2 on the side opposite the cross-bore, i.e., at the front end 48 of the nozzle pin 6.

The bottom 50 of the pressure chamber 49 is provided with a ring-shaped sealing surface 51, which, together with a corresponding sealing surface 52 on the front end 48 of the nozzle pin 6, partitions the pressure chamber 49 into two areas sealed against each other, whenever the nozzle pin 6 is resting against the bottom.

Adjoining pressure chamber 49 a polished cylindrical surface 54 is provided up to a height 53 in bore 5 of the nozzle body 2, which together with a sealed part 54' of the nozzle pin 6 provides a seal. From this cylindrical surface 54 the nozzle openings 55 lead to the outside. The bottom end of the sealed part 54' is provided with a control edge 56 which will move across the cross-sections 57 of the nozzle openings 55 whenever the nozzle pin 6 is moving axially.

The axial movement of the nozzle pin 6 and thus of the control edge 56 relative to the nozzle body 2 and thus to the opening cross-sections 57 is determined (a) by the fuel fed under pressure into the pressure chamber 49 via the axial bore 47, and (b) by the respective force of the spring 37' which is contained in the annular chamber 27 and acts upon the nozzle pin. This spring 37' is secured against lateral motion by means of a neck 58 on the nozzle pin 6. The annular chamber 27 is connected with the feeder duct 23 via groove 26, bore 25 in plate 3, and via bores 24 and 21, thereby permitting the removal of waste air and leakage fuel from the annular chamber 27 in a simple manner.

A pressure increase of the fuel which is fed into the pressure chamber 49 via groove 42, bore 43, feeder bore 44, cross-bore 46 and axial bore 47 during the downward stroke of the plunger 8, will result in an axial shift of the nozzle pin 6 and thus of the control edge 56, depending on the characteristic of the spring 37', which will uncover at least part of the area of the cross-sections 57 of the nozzle openings 55, and will permit the fuel to flow from the nozzle openings 55.

Figure 2:
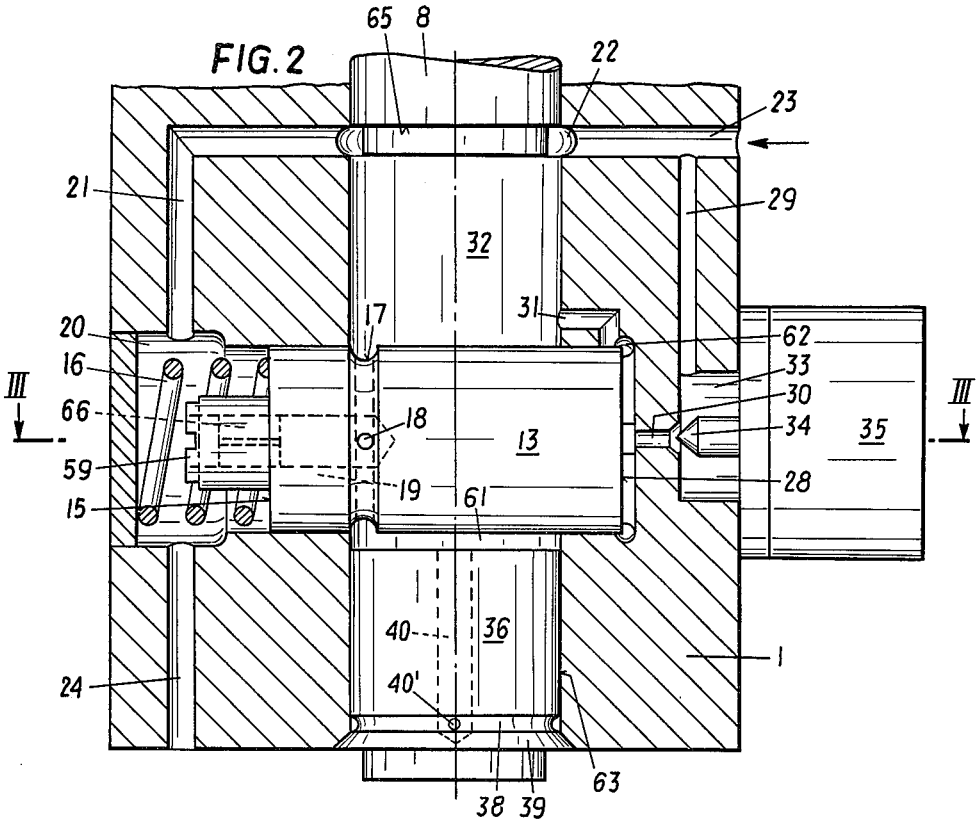
FIG. 2 shows a detail from FIG. 1 in an enlarged scale.
Figure 3:
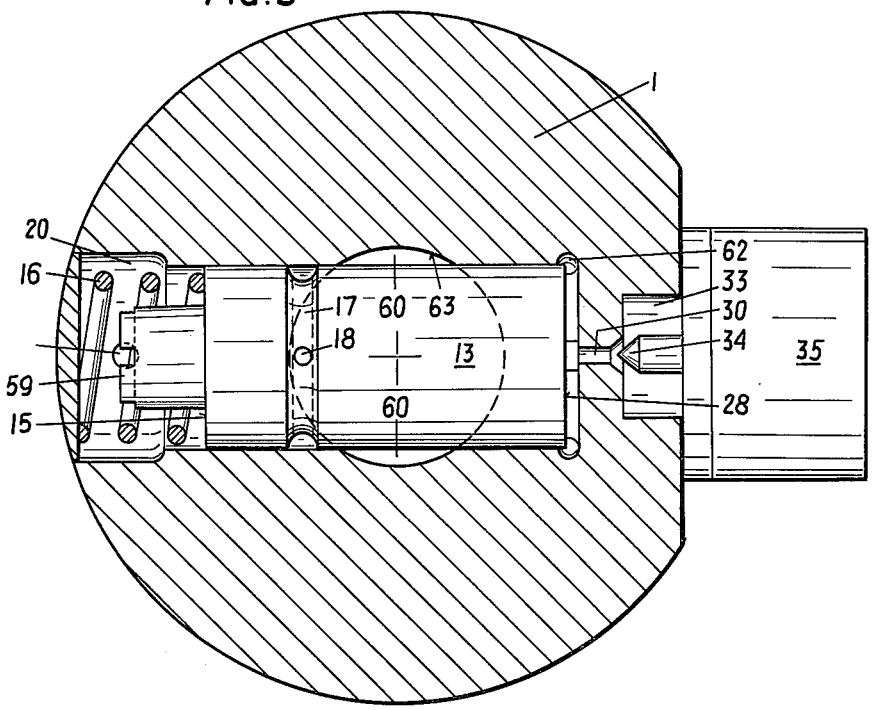
FIG. 3 shows a section along line III-III in FIG. 2.
Figure 4:
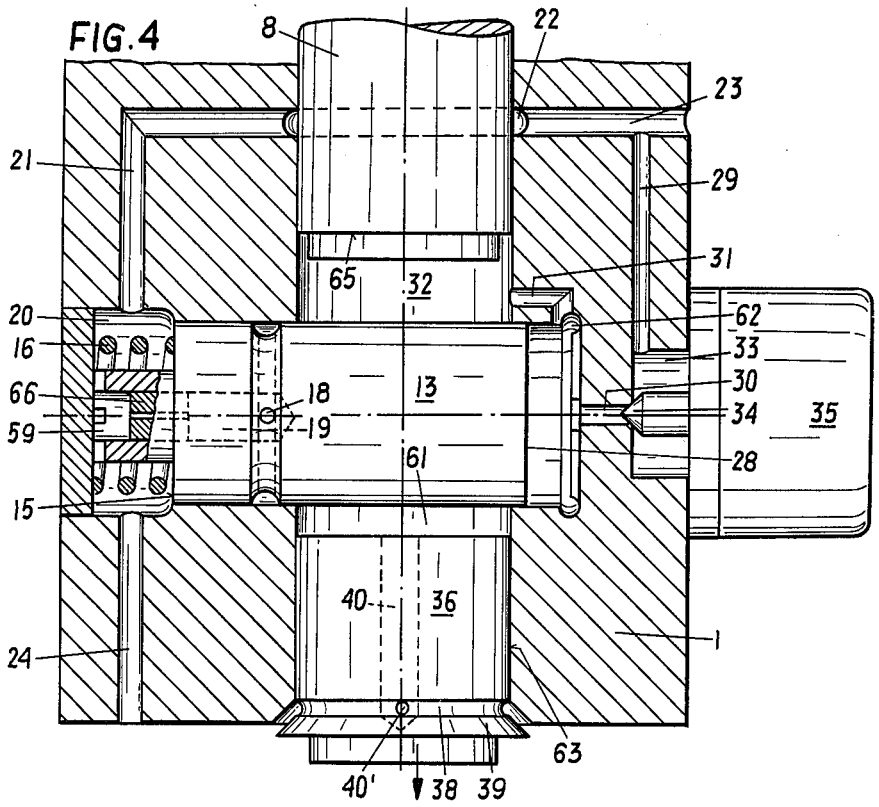
FIG. 4 shows the detail presented in FIG. 2, with a different position of the pump plunger.

FIGS. 2 to 4 illustrate the method of control of the fuel volume injected. The position of the control elements at the end of the intake stroke of the pump plunger 8 is shown in FIGS. 2 and 3, when the plunger is opening the annular groove 22 and thus establishing a connection between the feeder duct 23 and the pump pressure chamber 32, while the connection with bores 21 and 24 is maintained. In this way the left end 15 of the slide 13 is also subject to the fuel feed pressure, as is the right end 28 of the slide 13 via the connecting channel 31 and the annular groove 62 and via bores 29 and 30, since the solenoid valve 34 is opened by the action of a pressure spring (not shown in this drawing) as a consequence of a power switch-off. On account of the force of the helical spring 16 the slide 13 is in its right position, which will result in the annular groove 17 being positioned in the area of the pressure chamber 32 of the pump, where it will also be connected with the feeder duct of the pump via cross-bores 18 and the axia bore 19. The back valve 36 is shut by the spring 37(FIG. 1).

At the beginning of fuel injection the solenoid valve 34 is switched on and closed. The fuel which is forced into the pressure chamber 32 by the downward stroke of the pump plunger, may now flow off into the annular groove 22 and thus into the fuel feeder duct 23 via bores 18, 19, 21.

The annular groove 22 is separated from the pressure chamber 32 of the pump and is sealed tight by means of a control edge 65 of the pump plunger 8.

Due to the action of a throttle element 66 located in bore 19, the pressure build-up caused by the outflowing fuel will be greater in the pressure chamber 32 than in chamber 20. Via the connecting channel 31 the higher pressure may propagate into chamber 62.

In this way there is a rapid pressure build-up on the right end 28 of the slide 13, which will cause the slide 13 to move abruptly to its left end-position against the force of the spring 16, the nose 59 of the slide 13 acting as a stop, as shown in FIG. 4. In this case the annular groove 17 is situated on the left, outside of the pressure chamber 32 of the pump, and is shut off from the pressure chamber 32 by the pump body 1. Thus the fuel delivered by the pump plunger 8 is forced under high pressure into the chamber 61 above the back valve 36, via the flow cross-sections 60 forming between the slide 13 and the guide bore 63 of the back valve 36. This process will cause the back valve 36 to open against the force of the spring 37, whereupon the fuel will flow via the axial bore 40 and the cross-bore 40' into the annular chamber 41 and further on towards the nozzle openings 55 by the route described above. The left end face 15 of the slide 13 therefore is continuously subject to the feed pressure of the pump, whereas the right end face 28 of the slide is under the high pressure of the pump during the injection process.

During the intake stroke of the pump plunger 8 the injection process may be initiated or terminated any time by closing or opening the solenoid valve 34, as the solenoid valve is in control of the pressure in the pressure chamber 32 of the pump, or rather that of the right end face 28 of the slide 13 and thus of the position of the latter. In this manner it is possible to modify the injection regimen via the control of the solenoid valve, e.g., the beginning or the end of delivery may be held constant for all loads, or both beginning and end of delivery may be varied by the solenoid valve. The invention will thus permit the amount of fuel injected to be precisely adapted to the special requirements of engine operation.

Figure 6:
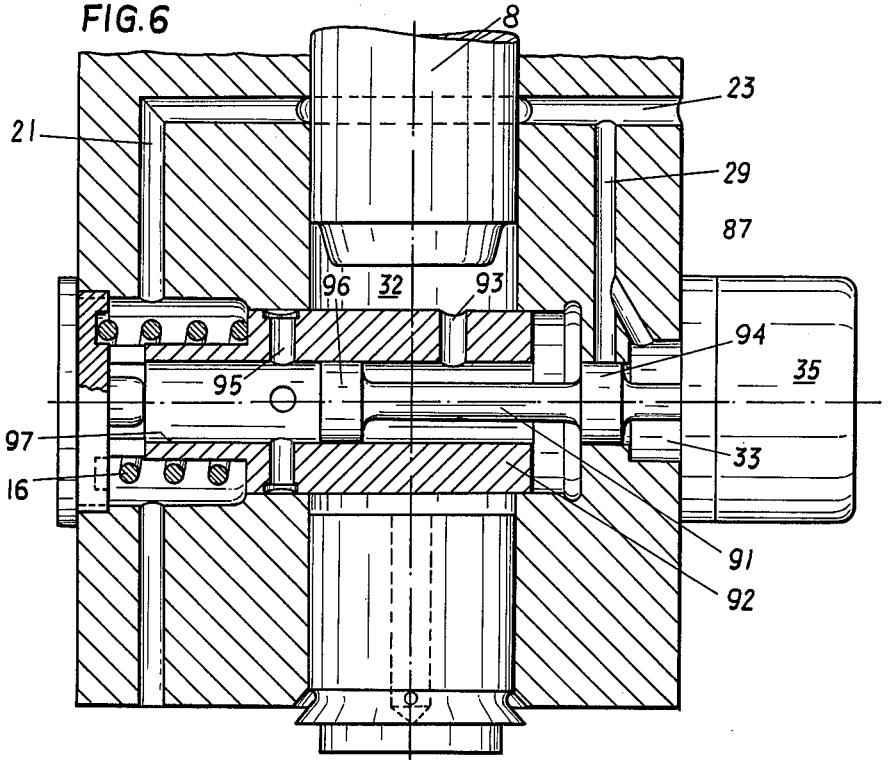
FIG. 6 shows another embodiment of the invention, presented as in FIG. 2.
Figure 5:
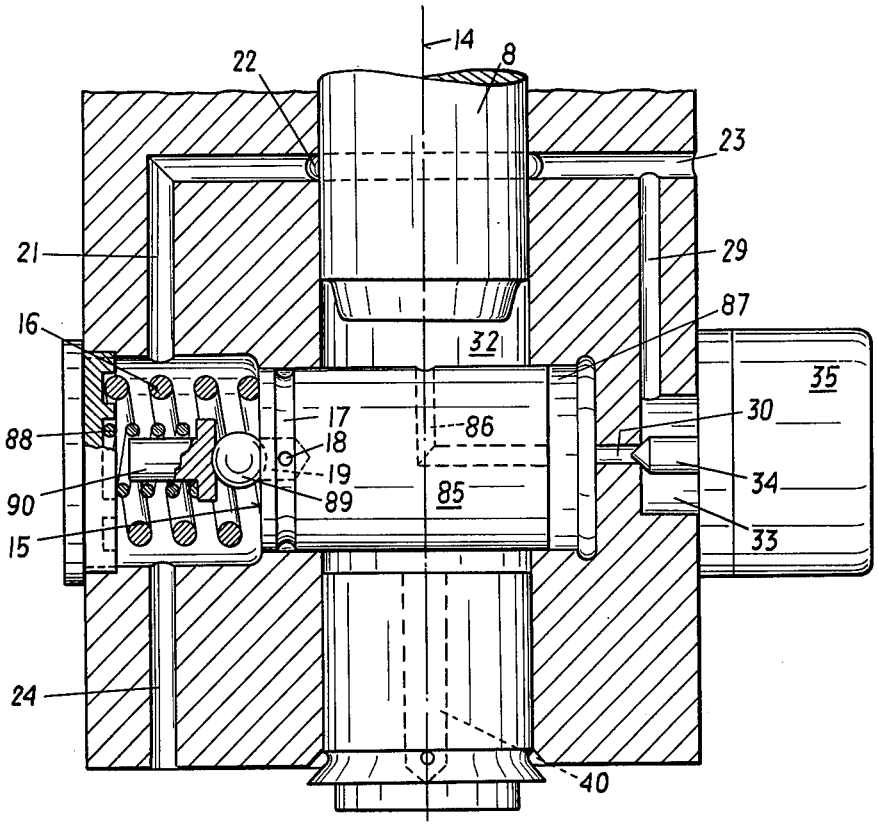
FIG. 5 shows another embodiment of the invention, presented as in FIG. 2.
Figure 5A:
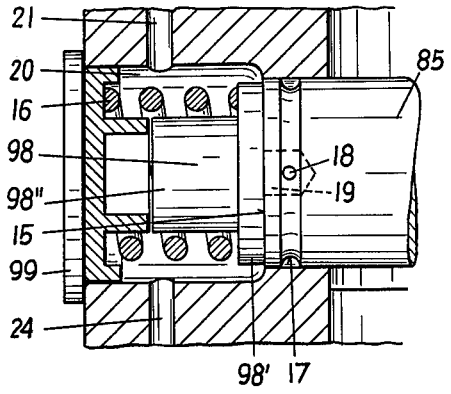
FIG. 5A shows the detail of a variant of FIG. 5.

FIGS. 5, 5A, and 6 are concerned with variants aimed at shortening the initial and final phases of the injection process, and at minimizing the forces to be exerted by the solenoid valve.

In the variant according to FIG. 5 a slide 85 is provided which is placed in a position normal to the axis 14 of the pump plunger 8 and which is smaller in diameter than the plunger. The slide 85 is provided with an L-shaped channel 86 which will permanently connect the pressure chamber 32 of the pump to the cylinder chamber 87 on the right-hand side of the slide 85. At a distance from its end 15 facing the helical spring 16, the slide 85 has an annular groove 17 which is connected with the axial bore 29 ending in end 15 by at least one cross-bore 18. During the downward stroke of the pump plunger 8 the control slide 85 will leave its right-hand end position only if the solenoid valve 34 is closed and if the pressure in the pressure chamber 32 of the pump has built up due to the choke effect of the cross-bores 18 to such an extent that the force exerted on the right-hand end of the control slide 85 outweighs that of the helical spring 16, thereby moving the control slide 85 to the left and covering up the annular groove 17. This will prevent any fuel from flowing off through the cross-bore 18. The choke effect of the cross-bore 18 may be achieved more accurately by introducing a back valve, e.g., configured as a ball 89 loaded by the spring 88. Via the bearing part 90 spring 88 acts upon the ball 89, part 90 forming the stop for the slide in its left end position at the same time. As soon as the solenoid valve 34 has been closed, the control slide 85 starts to move; the spherical back-valve will open only after the pressure in the cylinder chamber 87 on the right-hand side of the control slide 85 will have surpassed the force of the helical spring 16.

The positions of the control elements shown are those obtaining during the injection process, the slide 85 being held in its left end-position by the high pressure of the pump prevailing in the cylinder chamber 87, against the forces of springs 16 and 88. During this period the solenoid valve 34 in the housing 35 is in it shut position as shown, the bore 30 which may be used for establishing a connection with the feeder duct 23, being closed.

When the solenoid valve 34 is switched off, it will open bore 30, thereby establishing a flow-connection between the cylinder chamber 87 and the feeder duct 23 via the annular chamber 33 and the bore 29, which will lower the pressure in the pressure chamber of the pump until the injection process is interrupted.

In the variant according to FIG. 5A a disk valve 98 is provided instead of the ball valve, which consists of the valve disk 98' and the cylindrical neck 98" and is loaded by the helical spring 16. This disk valve 98 will control the bore 19 opening into the end face 15 of the plunger 85. The neck 98" will provide both a guide and the stop for the control slide 85 in its left end position as drawn, the neck 98" resting against the cover 99 sealing the chamber 20 containing the helical spring 16.

The variant shown in FIG. 6 differs from the variants of FIGS. 5 and 5A mainly by using as a throttle the web 96 of the control slide 91 instead of the ball valve (89, 90, 88) or the disk valve 98. The continuous connection between the pressure chamber 32 of the pump and the cylinder chamber 87 on the right-hand side of the slide 92 is ensured by the radial bore 93. Once again, the position of the control elements shown is that obtaining during the injection process, the flow-connection between the cylinder chamber 87 and the bore 29 being shut off by the web 94 of the control slide 91. The left side of the control slide 92 is connected with the feeder duct 23 via the bore 21.

The injection process may be interrupted by switching off the solenoid valve 34, in which case the web 94 together with the control slide 91 will move to the right and the cylinder chamber 87 will be connected with the feeder duct 23 via the bore 29. In this way the pressure in the cylinder chamber 87 is reduced to such a degree that the force of the helical spring 16 is permitted to move the slide 92 to the right. This movement is accelerated when the radial bores 95 enter the area of the pressure chamber 32 of the pump so that the pressure chamber is connected with the feeder duct 23 of this area as well.

On the other hand, switching on the solenoid valve 34 will initiate the process of injection, thereby increasing the pressure in the pressure chamber of the pump. In order to prevent this pressure from being compensated via the bores 95, the web 96 of the control slide 91 serving as a throttle is used for narrowing the outlet cross-sections of the above bores, leading to another pressure gradient. The pressure difference arising between the two ends of the control slide 91 will move the slide to the left against the force of the helical spring 16.

I claim:

1. A fuel injection pump for internal combustion engines, including a pump body having a pump cylinder and a guide bore transversely disposed thereto, an externally actuated pump plunger reciprocable in said cylinder and defining therewith a pump pressure chamber, a slide-type shutoff device disposed for sliding movement within said bore, said pump body having a fuel feed duct and fuel channel means connecting said duct with opposite ends of said device, a return spring within said body at one end of said device, one of said pump body and said device having a connecting channel extending between said chamber and an opposite end of said device, said device having an annular peripheral groove and bore means extending from said groove into said one end, said pump body further having an annular groove connected with said duct, opening toward said chamber and being disposed directly beneath said pump plunger when in its upper end position, solenoid actuated valve means controlled by at least one of the state variables essential for operation of the engine, such as load, engine speed, pressure and temperature of combustion air, etc., is provided for controlling the injection process by means of said device, said device under the action of said spring being disposed during the filling phase of the pump such that said peripheral groove thereof opens into said chamber, and said device being disposed in a fuel injection position thereof such that said peripheral groove thereof is covered by said pump body at the wall of said guide bore thereof.

2. The fuel injection pump according to claim 1 wherein said solenoid actuated valve means is disposed for controlling said fuel channel means from said duct to said opposite end of said device, said solenoid actuated valve means including a valve spring loaded in direction opposite a closing position, and including means energizing said valve into the closing position.

3. The fuel injection pump according to claim 1 or 2, wherein said bore means of said device is provided with an adjustable throttling element.

4. The fuel injection pump according to claim 3 wherein said throttling element comprises a valve means.

5. The fuel injection pump according to claim 4, wherein said valve means comprises a ball check valve.

6. The fuel injection pump acording to claim 4, wherein said valve means comprises a disc valve, said return spring being supported on said disc valve.

7. The fuel injection pump according to claim 6, wherein an outer end of said disc valve defines a step when said device is disposed in said fuel injection position.

8. The fuel injection pump according to claim 3, wherein said solenoid actuated valve means includes said throttling element which comprises a pair of spaced webs, said bore means of said device including an axial through-bore provided in said device and radial bores extending outwardly thereof, one of said webs being slideable along said through-bore, and the other of said webs being disposed for controlling said fuel channel means from said duct to said opposite end of said device.

* * * * *